US007764193B2

(12) United States Patent
Chen

(10) Patent No.: US 7,764,193 B2
(45) Date of Patent: Jul. 27, 2010

(54) TRAFFIC REGULATION SYSTEM

(75) Inventor: Ga-Lane Chen, Santa Clara, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 286 days.

(21) Appl. No.: 11/923,014

(22) Filed: Oct. 24, 2007

(65) Prior Publication Data

US 2008/0122653 A1 May 29, 2008

(30) Foreign Application Priority Data

Nov. 24, 2006 (CN) ..... 2006 1 0157070

(51) Int. Cl.
*G08G 1/095* (2006.01)
*G08G 1/08* (2006.01)
*G08G 1/07* (2006.01)

(52) U.S. Cl. ..... 340/907; 340/909; 340/916; 340/917; 340/925; 340/944

(58) Field of Classification Search ..... 340/907
See application file for complete search history.

(56) References Cited

U.S. PATENT DOCUMENTS 4,833,534 A * 5/1989 Paff et al. ..... 348/151
5,648,904 A 7/1997 Scott
2003/0128106 A1* 7/2003 Ross ..... 340/435
2004/0075583 A1* 4/2004 Chaffe ..... 340/944
2005/0266160 A1* 12/2005 Bond et al. ..... 427/164
2005/0278098 A1* 12/2005 Breed ..... 701/45
2007/0096943 A1* 5/2007 Arnold et al. ..... 340/907
2007/0097526 A1* 5/2007 Chiang ..... 359/819

* cited by examiner

*Primary Examiner*—Daniel Wu
*Assistant Examiner*—Pameshanand Mahase
(74) *Attorney, Agent, or Firm*—Jeffrey T. Knapp

(57) ABSTRACT

A traffic regulation system (100) includes a first traffic light (110) for controlling traffic in a first direction, a second traffic light (120) for controlling traffic in a second direction intersecting the first direction, an infrared light detector (130) for receiving an infrared light signal transmitted from a pedestrian proceeding in the second direction on a pedestrian crossing and producing a corresponding feedback signal associated with the infrared light signal, and a control unit (160) for receiving the feedback signal from the infrared light detector and instructing the first traffic light and the second traffic light to signal the pedestrian to proceed in the second direction.

18 Claims, 3 Drawing Sheets

TRAFFIC REGULATION SYSTEM

BACKGROUND

1. Field of the Invention

The present invention relates to traffic regulation systems and, more particularly, to a traffic regulation system with an infrared light signal detecting function.

2. Description of Related Art

With the increasing number of cars and other automobiles on the roads, traffic accidents are increasing in many countries, especially at crossroads, T-junctions, pedestrian crossings and other traffic meeting points such as traffic circles.

Currently, traffic regulation systems are arranged at crossroads or T-junctions, pedestrian crossings to instruct drivers or pedestrians whether or not to halt. Traffic regulation systems generally have a plurality of traffic lights, and each of the traffic lights has a red traffic light, a green traffic light and a yellow traffic light.

However, conventional traffic regulation systems only light the red, green, and yellow traffic lights for a set amount of time. The time for the green traffic light is generally 20 or 30 seconds, and elderly people, children, or the handicapped may not be able to cross the crossroad or T-junction or pedestrian crossing within this amount of time. Thus, the traffic accidents often happen because the elderly, children or the handicapped cannot cross in time, time.

What is needed, therefore, is a traffic regulation system, which can ensure the safety of the pedestrians.

SUMMARY

A traffic regulation system according to a preferred embodiment, includes a first traffic light for controlling traffic in a first direction, a second traffic light for controlling traffic in a second direction intersecting the first direction, an infrared light detector for receiving an infrared light signal transmitted from a pedestrian proceeding in the second direction on a pedestrian crossing and producing a corresponding feedback signal associated with the infrared light signal, and a control unit for receiving the feedback signal from the infrared light detector and instructing the first traffic light and the second traffic light to signal the pedestrian to proceed in the second direction.

The present traffic regulation system employs the infrared light detector to detect whether the pedestrian in the second direction has safely passed through the pedestrian crossing. Therefore, the present traffic regulation system can effectively avoid traffic accidents involving pedestrians.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present traffic regulation system can be better understood with reference to the following drawings. The components in the drawings are not necessarily to scale, the emphasis instead being placed upon clearly illustrating the principles of the present traffic regulation system. Moreover, in the drawings, like reference numerals designate corresponding parts throughout the several views.

DETAILED DESCRIPTION OF THE EMBODIMENT

Reference will now be made to the drawings to describe a preferred embodiment of the present traffic regulation system in detail.

Figure 1:
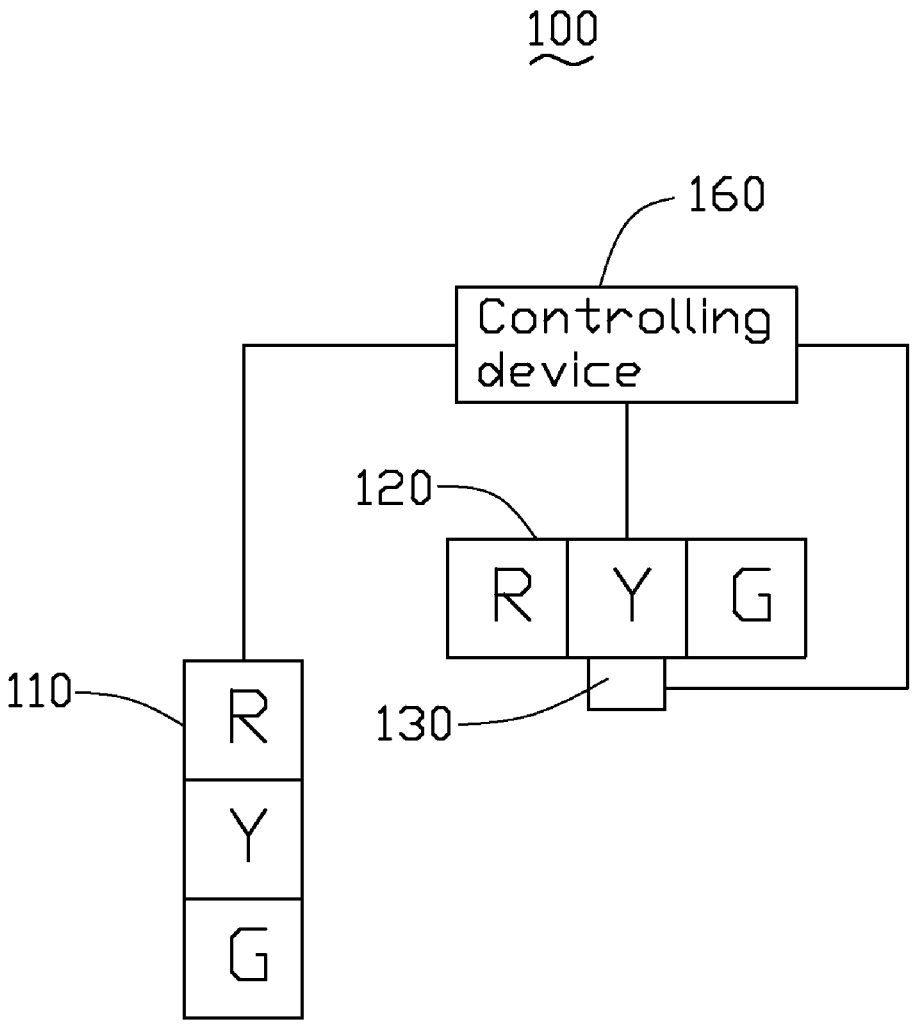
FIG. 1 is a diagram of a traffic regulation system according to a first preferred embodiment of the present invention.

Referring to FIG. 1, a traffic regulation system 100 in accordance with a first preferred embodiment, includes a first traffic light 110, a second traffic light 120, an infrared light detector 130 and a control unit 160. The first traffic light 110 is arranged facing in a first direction for controlling traffic in the first direction. The second traffic light 120 is arranged facing in a second direction intersecting the first direction for controlling traffic in the second direction. The infrared light detector 130 is arranged to face in the second direction for receiving an infrared light signal transmitted from a pedestrian proceeding in the second direction on a pedestrian crossing and producing a corresponding feedback signal associated with the infrared light signal. The control unit 160 communicates with the infrared light detector 130 for receiving the feedback signal from the infrared light detector 130 and instructing the first traffic light 110 and the second traffic light 120 to signal the pedestrian to proceed in the second direction.

The first traffic light 110 and the second traffic light 120 respectively include a red color traffic light, a green color traffic light and a yellow color traffic light for respectively regulating the traffics in the first direction or in the second direction.

The traffic regulation system 100 further includes a first infrared light transmitter for being carried by the pedestrian on the pedestrian crossing. Preferably, the first infrared transmitter may be attached on hand sticks, clothes or hat of the pedestrian.

Figure 2:
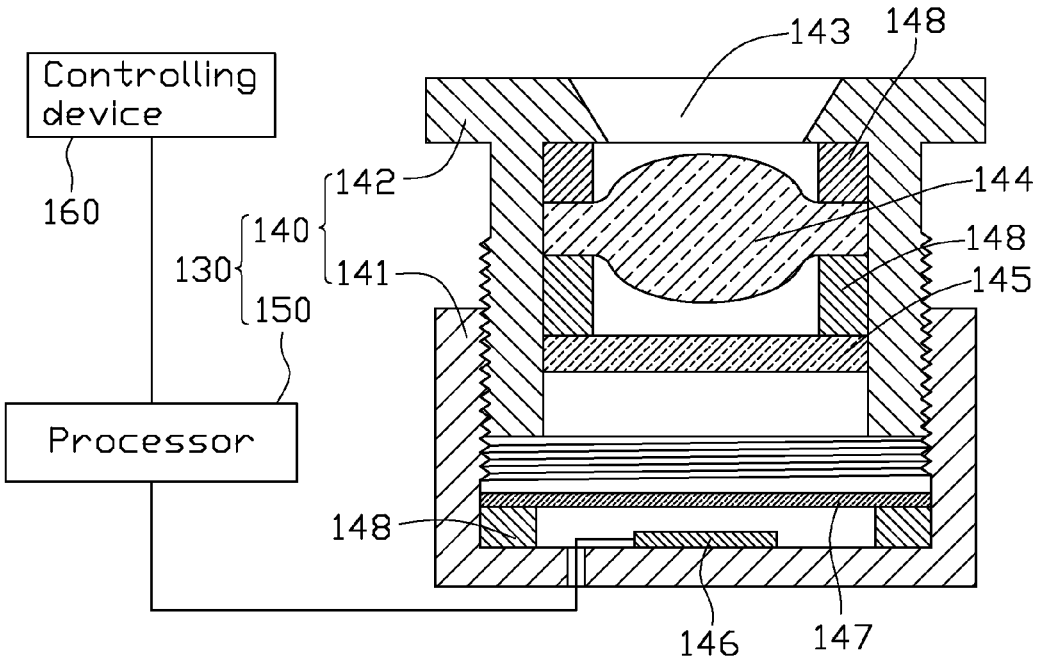
FIG. 2 is a schematic, cross-sectional view of an infrared light detector of FIG. 1.

Referring to FIG. 2, the infrared light detector 130 includes a camera module 140 configured for receiving the infrared light signal and a processor 150 communicating with the camera module 150 for processing the infrared light signal and producing a feedback signal. The processor 150 also communicates with the control unit 160 for transmitting the feedback signal to the control unit 160.

The camera module 140 includes a holder 141, a barrel 142 threadingly engaged with the holder 141, an infrared glass cover 143 arranged on the barrel 142, a lens 144 arranged in the barrel 142, and an image pickup module 146 mounted in the holder 141. The lens 144 is arranged between the infrared glass cover 143 and the image pickup module 146.

The infrared glass cover 143 is made of an infrared glass, which only permits infrared light to pass through, and prevents visible light passing through. Preferably, the infrared glass cover 143 may be made of a specific infrared glass, which only permits infrared light having wavelengths in a certain range passing through.

The lens 144 may be a aspheric lens. Preferably, an anti-reflective coating covers on the lens 144 to reduce reflection of infrared light. A plurality of spacers 148 are arranged between the lens 144 and the infrared glass cover 143.

The image pickup module 146 is fixed in the holder 141 and configured for detecting the infrared light signal to form an image. The image pickup module 146 usually is a charge coupled device (CCD) or a complementary metal-oxide semiconductor (CMOS) device.

The camera module 140 further includes an infrared pass-band filter 145 arranged between the lens 144 and the image pickup module 146. The infrared passband filter 145 includes a plurality of oxide layers, such as titanium dioxide (TiO2), silicon dioxide (SiO2), etc., for filtering the visible light and only permitting the infrared light to pass through. A plurality of spacers 148 are arranged between the lens 144 and the infrared passband filter 145. Preferably, the infrared passband filter 145 includes a plurality of specific oxide layers, which only permits infrared light in certain wavelength ranges to pass through. The infrared passband filter 145 has a high resolution capability for the infrared light, and the infrared glass cover 143 has a low resolution capability for the infrared light. For high resolution products, the infrared passband filter 145 and the infrared glass cover 143 are need to obtain a high resolution capability. For mid resolution products, only the infrared passband filter 145 is need to obtain a mid resolution capability. For the low resolution products, only the infrared glass cover 143 is need to obtain a low resolution capability.

The camera module further includes a transparent cover 147 arranged on the image pickup module 146 for preventing dust polluting the image pickup module 146. A plurality of spacers 148 can be arranged between the transparent cover 147 and the image pickup module 146.

The image pickup module 146 communicates with the processor 150 for transmitting the image to the processor 150 to produce the feedback signal. The control unit 160 receives the feedback signal and controls the first and second traffic light 110, 120.

In operation, when the green color traffic light of the second traffic light 120 is on, the pedestrian can proceed in the second direction on the pedestrian crossing. When the green color traffic light of the second traffic light is due to be switched off, the infrared light detector 130 begins to operate and detect whether all the pedestrians in the second direction have completely passed through the route. The camera module 140 can receive the infrared light signal transmitted from the first infrared light transmitter carried by the pedestrian in the second direction to create a signal, for example, an image and transmit the image to the processor 150. The processor 150 processes the image to produce the feedback signal. If the camera module 140 does not receive the infrared light signal, that is, the pedestrian in the second direction has passed through the pedestrian crossing, the green traffic light of the second traffic light 120 closes to open the red traffic light of the second traffic light 120 for preventing the pedestrians in the second direction passing through the pedestrian crossing, and the green traffic light of the first traffic light 110 opens to permit the vehicle in the first direction to pass through. If the camera module 140 receives the infrared light signal, that is, if the pedestrian in the second direction has not passed through the pedestrian crossing, the green traffic light of the second traffic light 120 remains on to permit the pedestrians in the second direction to pass through the pedestrian crossing, and the red traffic light of the first traffic light 110 remains on to prevent the vehicle in the first direction passing through. When the camera module 140 stops receiving the infrared light signal, the red traffic light of the second traffic light 120 is switched on to prevent the pedestrian in the second direction passing through, and the green traffic light of the first traffic light 110 is switched on to permit the vehicle in the first direction to pass through.

The present traffic regulation system 100 employs the infrared light detector 130 to detect whether the pedestrian in the second direction has safely passed through the pedestrian crossing. Therefore, the present traffic regulation system 100 can effectively avoid the traffic accidents since the elderly, children or handicapped only pass half of the crossroads or T-shaped roads at the certain time for the green traffic light.

Figure 3:
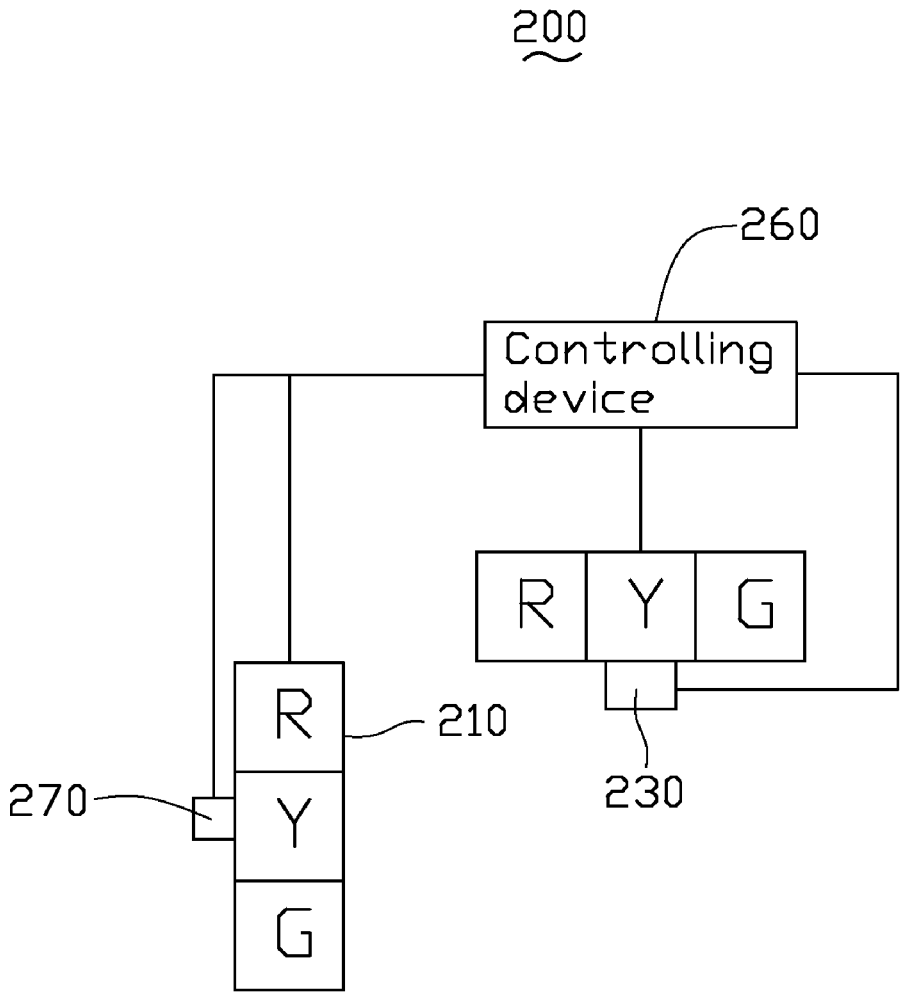
FIG. 3 is a diagram of a traffic regulation system according to a second preferred embodiment of the present invention.

Referring to FIG. 3, a traffic regulation system 200 in accordance with a second preferred embodiment is shown. The traffic regulation system 200 is similar to that of the first preferred embodiment, expect that the traffic regulation system 200 further includes a second infrared light transmitter 270 facing the first direction and communicating with the controlling device 260. The second infrared light transmitter 270 is configured for sending out an infrared signal to an infrared receiver set on a vehicle running in the first direction to cause the vehicle to pull up during a time period when the infrared detector 230 receives the infrared signal transmitted from the pedestrian proceeding in the second direction on the pedestrian crossing. When the infrared receiver set on the vehicle running in the first direction receives the infrared signal transmitted from the second infrared light transmitter 270, a motor or an ignition system of the vehicle can be locked to cause the vehicle pull up.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A traffic regulation system, comprising:

a first traffic light for controlling traffic in a first direction;

a second traffic light for controlling traffic in a second direction intersecting the first direction;

an infrared light detector comprising a camera module and a processor, the camera module configured for receiving an infrared light signal transmitted from a pedestrian proceeding in the second direction on a pedestrian crossing, the camera module comprising a holder, a barrel threadedly engaged with the holder, an infrared glass cover on the barrel, a lens arranged in the barrel, and an image pickup module mounted in the holder, and the processor configured for processing the infrared light signal and producing a corresponding feedback signal associated with the infrared light signal and transmitting the feedback signal; and a control unit for receiving the feedback signal from the infrared light detector and instructing the first traffic light and the second traffic light to signal the pedestrian to proceed in the second direction.

2. The traffic regulation system as claimed in claim 1, wherein the first traffic light has a red traffic light, a green traffic light, and a yellow traffic light.

3. The traffic regulation system as claimed in claim 1, wherein the second traffic light has a red traffic light, a green traffic light, and a yellow traffic light.

4. The traffic regulation system as claimed in claim 1, further comprising a first infrared light transmitter for arrangement on the pedestrian who is on the pedestrian crossing for sending out the infrared light signal.

5. The traffic regulation system as claimed in claim 1, wherein the lens is arranged between the infrared glass cover and the image pickup module.

6. The traffic regulation system as claimed in claim 1, wherein the camera module further comprises an infrared passband filter arranged between the lens and the image pickup module.

7. The traffic regulation system as claimed in claim 6, wherein the infrared passband filter includes a plurality of oxide layers.

8. The traffic regulation system as claimed in claim 1, wherein the camera module further comprises a transparent cover arranged on the image pickup module.

9. The traffic regulation system as claimed in claim 8, wherein the transparent cover is made of an infrared glass.

10. The traffic regulation system as claimed in claim 1, further comprising a second infrared light transmitter for sending out an infrared light signal to an infrared receiver set on a vehicle running in the first direction to cause the vehicle to pull up during a time period when the infrared light detector receives the infrared light signal transmitted from the pedestrian proceeding in the second direction on the pedestrian crossing.

11. A traffic regulation system, comprising:

a first traffic light for controlling traffic in a first direction;

a second traffic light for controlling traffic in a second direction intersecting the first direction;

an infrared light detector for receiving a first infrared light signal transmitted from a pedestrian proceeding in the second direction on a pedestrian crossing and producing a corresponding feedback signal associated with the first infrared light signal;

an infrared light transmitter for sending out a second infrared light signal to a vehicle running in the first direction to cause the vehicle to pull up during a time period when the infrared light detector receives the first infrared light signal transmitted from the pedestrian proceeding in the second direction on the pedestrian crossing; and a control unit for receiving the feedback signal from the infrared light detector and instructing the first traffic light and the second traffic light to signal the pedestrian to proceed in the second direction.

12. The traffic regulation system as claimed in claim 11, further comprising a first infrared light transmitter for arrangement on the pedestrian who is on the pedestrian crossing for sending out the first infrared light signal.

13. The traffic regulation system as claimed in claim 11, wherein the infrared light detector comprises a camera module configured for receiving the first infrared light signal and a processor configured for processing the first infrared light signal and producing a feedback signal and transmitting the feedback signal to the control unit.

14. The traffic regulation system as claimed in claim 13, wherein the camera module comprises a holder, a barrel threadedly engaged with the holder, an infrared glass cover on the barrel, a lens arranged in the barrel, and an image pickup module mounted in the holder.

15. A traffic regulation system, comprising:

a first traffic light for controlling traffic in a first direction;

a second traffic light for controlling traffic in a second direction intersecting the first direction;

an infrared light detector comprising a camera module and a processor, the camera module configured for receiving an infrared light signal transmitted from a pedestrian proceeding in the second direction on a pedestrian crossing, and the processor configured for processing the infrared light signal and producing a corresponding feedback signal associated with the infrared light signal and transmitting the feedback signal; and a control unit for receiving the feedback signal from the infrared light detector and instructing the first traffic light and the second traffic light to signal the pedestrian to proceed in the second direction.

16. The traffic regulation system as claimed in claim 15, wherein the camera module comprises a holder, a barrel threadedly engaged with the holder, an infrared glass cover on the barrel, a lens arranged in the barrel, and an image pickup module mounted in the holder.

17. The traffic regulation system as claimed in claim 16, wherein the lens is arranged between the infrared glass cover and the image pickup module.

18. The traffic regulation system as claimed in claim 16, wherein the camera module further comprises an infrared passband filter arranged between the lens and the image pickup module.

* * * * *